US007138964B2

(12) United States Patent
Ko et al.

(10) Patent No.: US 7,138,964 B2
(45) Date of Patent: Nov. 21, 2006

(54) MOBILE UNIT WITH DUAL PANEL DISPLAY

(75) Inventors: Chung-Wen Ko, Taipei County (TW); Yi-Cheng Chang, Taipei (TW)

(73) Assignee: Au Optronics Corp., Hsinchu (TW)

( * ) Notice: Subject to any disclaimer, the term of this patent is extended or adjusted under 35 U.S.C. 154(b) by 136 days.

(21) Appl. No.: 10/747,406

(22) Filed: Dec. 30, 2003

(65) Prior Publication Data

US 2005/0146282 A1 Jul. 7, 2005

(51) Int. Cl.
*G09G 5/00* (2006.01)

(52) U.S. Cl. ..... 345/55; 345/588; 315/169.1

(58) Field of Classification Search .. 315/169.1–169.4, 315/167; 345/55–68, 84–87, 204, 207, 211, 345/92, 96, 105, 588, 684, 625, 626
See application file for complete search history.

(56) References Cited

U.S. PATENT DOCUMENTS

| | | | | |
|---|---|---|---|---|
| 4,508,990 | A | 4/1985 | Essinger | 313/50 |
| 4,578,617 | A | 3/1986 | Kerr, III et al. | 313/512 |
| 4,619,624 | A | 10/1986 | Kerr, III et al. | 445/22 |
| 4,668,582 | A | 5/1987 | Matsuoka et al. | 428/690 |
| 4,788,629 | A | 11/1988 | Handy et al. | 362/23 |
| 4,855,641 | A | 8/1989 | Nakamura et al. | 313/605 |
| 4,954,752 | A | 9/1990 | Young et al. | 315/169.3 |
| 4,958,105 | A | 9/1990 | Young et al. | 315/169.3 |
| 4,974,383 | A | 12/1990 | Derr et al. | 52/404.4 |
| 4,975,692 | A | 12/1990 | Tateyama | 345/102 |
| 4,986,876 | A | 1/1991 | Zeto et al. | 216/5 |
| 5,557,295 | A | 9/1996 | Miyashita et al. | 345/36 |
| 5,893,637 | A | 4/1999 | Mizuno | 362/489 |
| 5,961,733 | A | 10/1999 | Strange | 134/10 |
| 6,019,110 | A | 2/2000 | McClure et al. | 134/56 R |
| 6,025,894 | A | 2/2000 | Shirasaki et al. | 349/69 |
| 6,044,854 | A | 4/2000 | Marks | 134/111 |
| 6,074,491 | A | 6/2000 | McClure et al. | 134/10 |
| 6,095,163 | A | 8/2000 | McClure et al. | 134/111 |
| 6,207,301 | B1 | 3/2001 | Ohnishi et al. | 428/690 |
| 6,235,201 | B1 | 5/2001 | Smith et al. | 210/691 |
| 6,255,781 | B1 | 7/2001 | Tsumura | 315/169.1 |
| 6,328,045 | B1 | 12/2001 | Strange | 134/111 |
| 6,358,422 | B1 | 3/2002 | Smith et al. | 210/691 |
| 6,374,835 | B1 | 4/2002 | McClure et al. | 134/108 |
| 6,398,951 | B1 | 6/2002 | Smith et al. | 210/85 |
| 6,398,966 | B1 | 9/2002 | Smith et al. | 210/691 |

(Continued)

FOREIGN PATENT DOCUMENTS

| | | |
|---|---|---|
| TW | 556447 | 9/2002 |

*Primary Examiner*—Wilson Lee
(74) *Attorney, Agent, or Firm*—Thomas, Kayden, Horstemeyer & Risley

(57) ABSTRACT

An electroluminescence display device that comprises an array of pixels, an electroluminescence device formed in each of the pixels, a first electrode formed in the electroluminescence device, a second electrode formed in the electroluminescence device, an electroluminescence layer formed in the electroluminescence device between the first and second electrodes to emit light through the first and second electrodes, a plurality of scan drivers to activate the array of pixels, and a control unit to control a scanning sequence of the plurality of scan drivers, the electroluminescence display device further comprising a first mode wherein the array of pixels are activated in a sequence from a first row to a last row, and a second mode wherein the array of pixels are activated in a sequence from the last row to the first row.

20 Claims, 4 Drawing Sheets

U.S. PATENT DOCUMENTS 6,448,710 B1 9/2002 Asai et al. ..... 313/504
6,451,125 B1 9/2002 McClure et al. ..... 134/10
6,533,631 B1 3/2003 Asai et al. ..... 445/24
6,534,925 B1 * 3/2003 Kawashima ..... 345/76
6,542,207 B1 4/2003 Yoshizawa ..... 349/69
6,734,838 B1 * 5/2004 Eichenlaub ..... 345/87
6,864,637 B1 * 3/2005 Park et al. ..... 315/169.1

* cited by examiner

MOBILE UNIT WITH DUAL PANEL DISPLAY

DESCRIPTION OF THE INVENTION

1. Field of the Invention

This invention relates in general to a display device and, more particularly, to an electroluminescence display device including a transparent display panel and a method of driving the electroluminescence display device.

2. Background of the Invention

An electroluminescence display device typically uses a light-emitting element to emit light instead of a backlight as in a liquid crystal display, and therefore may be used outdoors. Electronic products which use electroluminescence display devices may include lap-top computers, televisions, digital watches, calculators, telephones and cellular phones.

Some of the electronic products in the art, for example, cellular phones, are designed with a shell-type outlook, including a display panel foldable with respect to an operation member. The operation member allows a user of the shell-type electronic product to enter information through, for example, a keyboard. The display panel may include a main panel and a sub-panel. Generally, the main panel serves to provide main display functions of the electronic product, and the sub-panel serves to provide subsidiary display functions such as caller identity display or clock display. The main panel and the sub-panel are generally independent of each other, and include individual driving circuits and electroluminescence elements. The electronic products in the art based on the double-panel design therefore provide a sub-panel display function at the expense of manufacturing cost and overall product size.

SUMMARY OF THE INVENTION

Accordingly, the present invention is directed to an electroluminescence display device and a method of driving the electroluminescence display device that obviate one or more of the problems due to limitations and disadvantages of the related art.

To achieve these and other advantages, and in accordance with the purpose of the invention as embodied and broadly described, there is provided an electroluminescence display device that comprises an array of pixels, an electroluminescence device formed in each of the pixels, a first electrode formed in the electroluminescence device, a second electrode formed in the electroluminescence device, an electroluminescence layer formed in the electroluminescence device between the first and second electrodes to emit light through the first and second electrodes, a plurality of scan drivers to activate the array of pixels, and a control unit to control a scanning sequence of the plurality of scan drivers, the electroluminescence display device further comprising a first mode wherein the array of pixels are activated in a sequence from a first row to a last row, and a second mode wherein the array of pixels are activated in a sequence from the last row to the first row.

In one aspect, the electroluminescence device further comprises an organic light emitting diode.

In another aspect, the electroluminescence display device further comprises a display panel including the array of pixels, and an operation member coupled to the display panel.

Also in accordance with the present invention, there is provided an electroluminescence display device that comprises an operation member, a display panel foldable with respect to the operation member, an array of pixels formed in the display panel, and a scan driver to drive the array of pixels in a first sequence from a first row to a last row of the array of pixels when the display panel is disposed in a folded position, and to drive the array of pixels in a second sequence from a last row to a first row of the array of pixels when the display panel is disposed in an unfolded position.

In one aspect, the electroluminescence display device further comprises a pair of masks respectively disposed on both sides of the display panel.

Still in accordance with the present invention, there is provided a method of driving an electroluminescence display device that comprises the steps of providing an electroluminescence display device with a single display panel that is transparent on both sides, providing an array of pixels formed in rows and columns in the electroluminescence display device, activating the array of pixels in a first sequence from a first row to a last row of the array of pixels if the transparent display panel is viewed from one side, and activating the array of pixels in a second sequence from a last row to a first row of the array of pixels if the transparent display panel is viewed from the other side.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1A:
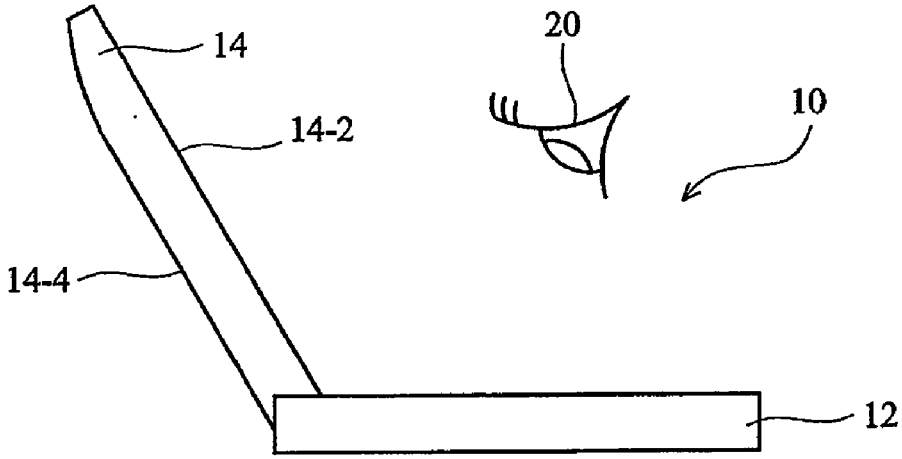
FIGS. 1A and 1B are schematic diagrams of an electroluminescence display device in accordance with one embodiment of the present invention.
Figure 1B:
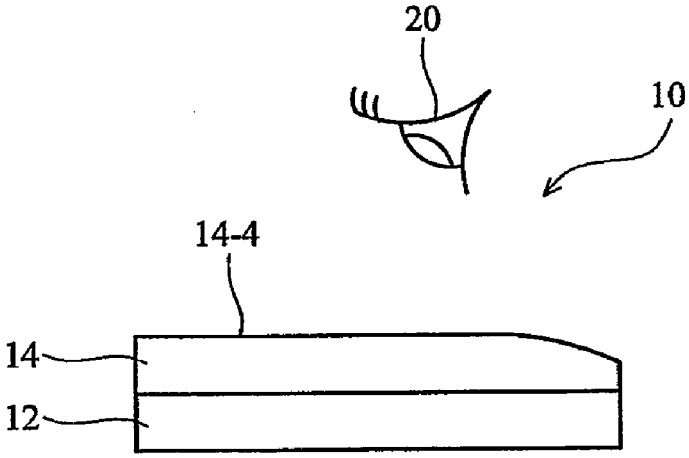

FIGS. 1A and 1B are schematic diagrams of an electroluminescence display device 10 in accordance with one embodiment of the present invention. Referring to FIGS. 1A and 1B, electroluminescence display device 10 includes an operation member 12 and a single display panel 14 foldable with respect to operation member 12. Operation member 12 may include a keyboard (not shown) that allows a user 20 of electroluminescence display device 10 to enter information. Display panel 14 allows user 20 to view a displayed image at both sides 14-2 and 14-4. Referring to FIG. 1A, when electroluminescence display device 10 operates in a first mode, that is, display panel 14 is held at an unfolded position or a remote position from operation member 12, user 20 views a displayed image at one side 14-2. Referring to FIG. 1B, when electroluminescence display device 10 operates in a second mode, that is, display panel 14 is held at a folded position or a contact position with operation member 12, user 20 views a displayed image at the other side 14-4.

Figure 2:
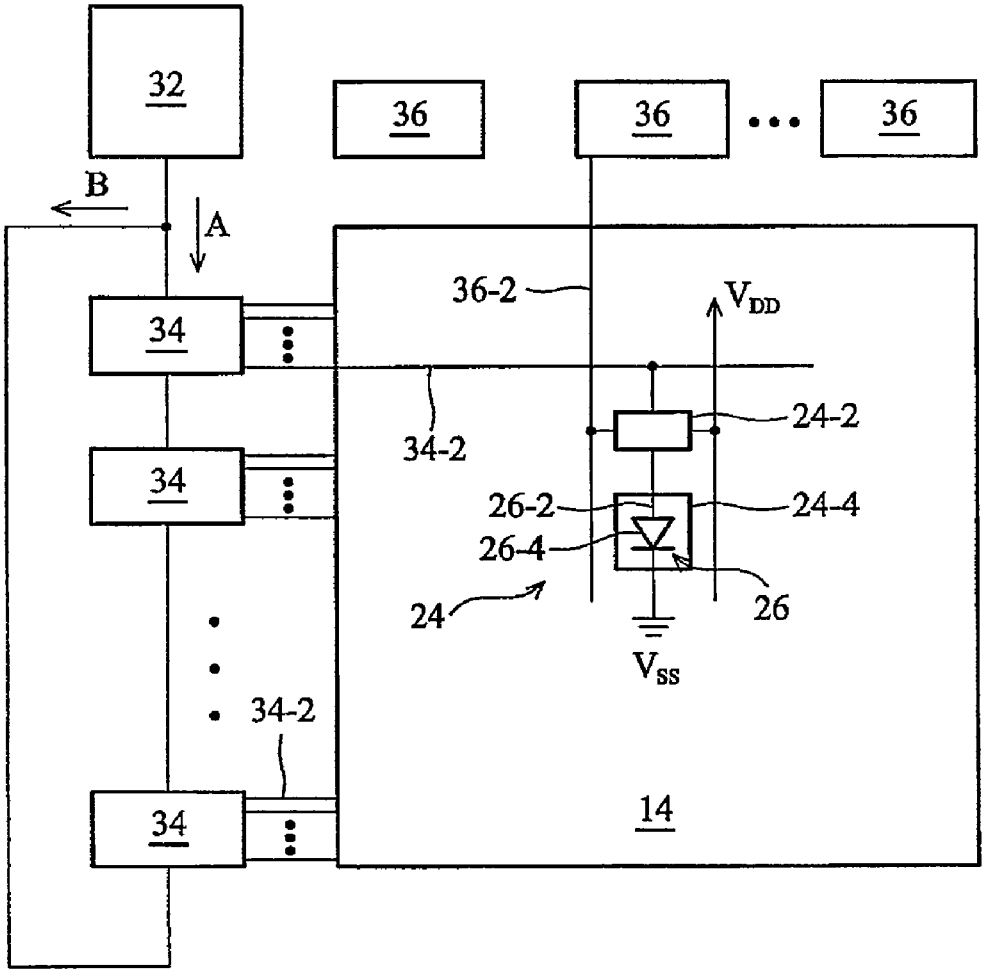
FIG. 2 is a schematic diagram of a driving circuit for the electroluminescence display device sown in FIGS. 1A and 1B.

FIG. 2 is a schematic diagram of a driving circuit for electroluminescence display device 10 shown in FIGS. 1A and 1B. Referring to FIG. 2, electroluminescence display device 10 includes a driving circuit (not numbered) to drive display panel 14. The driving circuit further includes a control unit 32, at least one scan driver 34, and at least one data driver 36. Display panel 14 further includes an array of pixels arranged in rows and columns. Each of the array of pixels is formed near the crossing of a scan line 34-2 coupled to one of the at least one scan driver 32 and a data line 36-2 coupled to one of the at least one data driver 36. A representative pixel 24 may include a controlling circuit 24-2, and an electroluminescence device 24-4. Controlling circuit 24-2 is activated or inactivated by a corresponding scan driver 34 via scan line 34-2, and may include field effect transistors (not shown) and capacitors (not shown). Electroluminescence device 24-4 includes an electroluminescence layer (not shown) to emit light toward both sides 14-2 and 14-4 of display panel 14. In one embodiment according to the present invention, electroluminescence device 24-4 includes an organic light emitting diode 26 which may further include a first transparent electrode 26-2, a second transparent electrode 26-4, and an organic electroluminescence layer (not shown) formed between first and second transparent electrodes 26-2 and 26-4. First and second transparent electrodes 26-2 and 26-4 are, for example, made of indium tin oxide ("ITO").

In operation, in response to a signal sent from control unit 32, scan driver 34 activates a selected row of pixels formed in display panel 14. Depending on the operation mode of electroluminescence display device 10, control unit 32 selects a corresponding path to send the signal to scan driver 34. If electroluminescence display device 10 operates in the first mode, control unit 32 sends the signal via a path A such that the array of pixels are activated in a first sequence from a first row to a last row. If electroluminescence display device 10 operates in the second mode, control unit 32 sends the signal via a path B such that the array of pixels are activated in a second sequence from a last row to a first row.

Figure 3A:
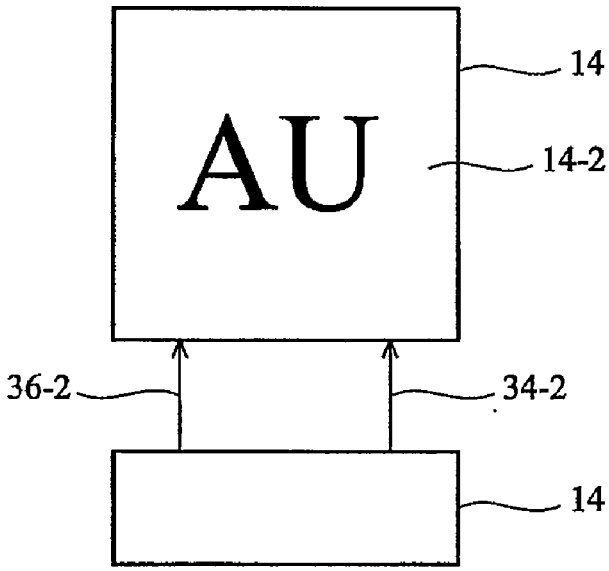
FIGS. 3A and 3B are diagrams respectively showing a result of display of the electroluminescence display device shown in FIGS. 1A and 1B.
Figure 3B:
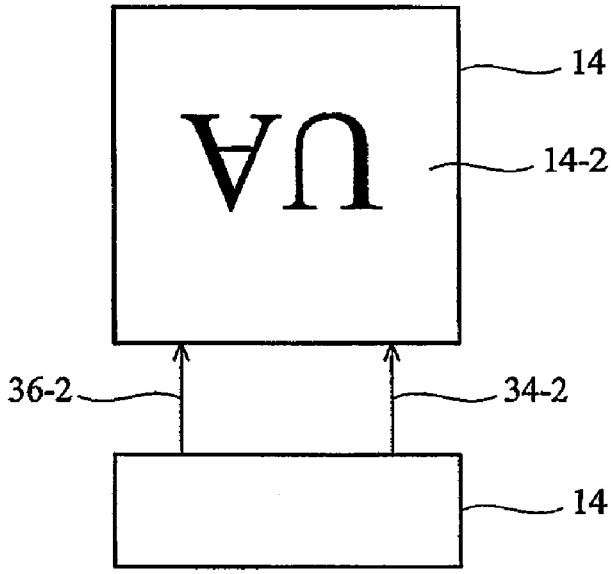

FIGS. 3A and 3B are diagrams respectively showing a result of display of electroluminescence display device 10 shown in FIGS. 1A and 1B. Referring to FIG. 3A, in the first mode that user 20 views display panel 14 at one side 14-2, control unit 32 provides the signal via path A, and in turn activates a selected row of pixels through scan line 34-2. Later, an image-data, for example, a word string "AU", provided from data driver 36 is sent via data line 36-2. Since scan driver 34 drives the array of pixels in the first sequence, the image data is displayed as it is, i.e., "AU", as viewed from the one side 14-2.

Referring to FIG. 3B, in the second mode that user 20 views display panel 14 at the other side 14-4, control unit 32 provides the signal via path B. Since scan driver 34 drives the array of pixels in the second sequence, the image data is displayed upside down, i.e., "∀∩", if viewed from the one side 14-2, but will meet the eyes of user 20 as the original form "AU" as user 20 views it in the other side 14-4.

Figure 4:
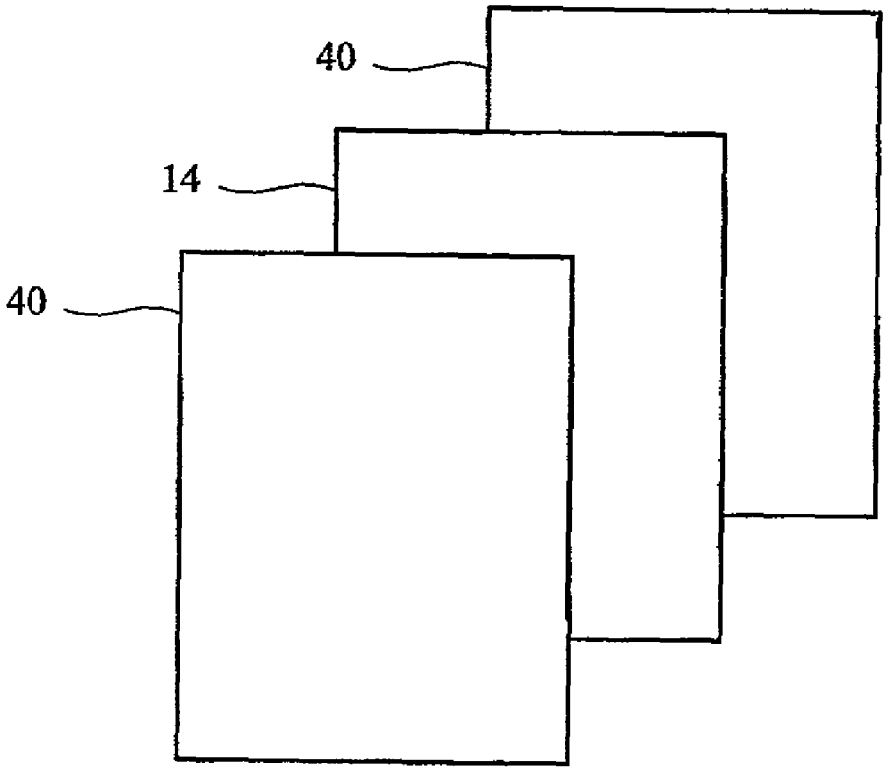
FIG. 4 is a schematic diagram of a display panel of an electroluminescence display device in accordance with another embodiment of the present invention.

FIG. 4 is a schematic diagram of display panel 14 of electroluminescence display device 10 in accordance with another embodiment of the present invention. Referring to FIG. 4, electroluminescence display device 10 may further include a mask 40 disposed at one side of display panel 14 to increase visibility or contrast of a displayed image when viewed from the other side. In one embodiment according to the invention, mask 40 includes a scroll lid that allows a manual control. In other embodiments, mask 40 includes an electrochromic film which is essentially colorless or nearly colorless to allow light to pass, and darkens or becomes opaque to attenuate light when a potential is applied. In one embodiment, mask 40 is provided at either sides of display panel 14 such that one of the masks 40 is transparent at a viewing side and the other mask 40 becomes opaque either manually or electrically.

The present invention also provides a method of driving an electroluminescence display device 10. Electroluminescence display device 10 is provided with a single display panel 14 that is transparent at both sides 14-2 and 14-4, and an array of pixels formed in rows and columns. The array of pixels are activated in a first sequence from a first row to a last row if display panel 14 is viewed from one side 14-2, and are activated in a second sequence from a last row to a first row if display panel 14 is viewed from the other side 14-4.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electroluminescence display device comprising:

an array of pixels;

an electroluminescence device formed in each of the pixels;

a first electrode formed in the electroluminescence device;

a second electrode formed in the electroluminescence device;

an electroluminescence layer formed in the electroluminescence device between the first and second electrodes to emit light through the first and second electrodes;

a plurality of scan drivers to activate the array of pixels; and a control unit to control a scanning sequence of the plurality of scan drivers;

the electroluminescence display device further comprising a first mode wherein the array of pixels are activated in a sequence from a first row to a last row, and a second mode wherein the array of pixels are activated in a sequence from the last row to the first row.

2. The device of claim 1, the electroluminescence layer further comprising an organic electroluminescence material.

3. The device of claim 1, the electroluminescence device further comprising an organic light emitting diode.

4. The device of claim 1 further comprising a display panel including the array of pixels, and an operation member coupled to the display panel.

5. The device of claim 4, the display panel being disposed in a remote position from the operation member when the display device operates in the first mode.

6. The device of claim 4, the display panel being disposed in a contact position with the operation member when the display device operates in the second mode.

7. The device of claim 4 further comprising a mask disposed on one side of the display panel.

8. The device of claim 7, the mask further comprising a scroll lid.

9. The device of claim 7, the mask further comprising an electrochromic film.

10. An electroluminescence display device comprising:

an operation member;

a display panel foldable with respect to the operation member;

an array of pixels formed in the display panel; and a scan driver to drive the array of pixels in a first sequence from a first row to a last row of the array of pixels when the display panel is disposed in a folded position, and to drive the array of pixels in a second sequence from a last row to a first row of the array of pixels when the display panel is disposed in an unfolded position.

11. The device of claim 10 further comprising a control unit electrically coupled to the scan driver to control a scanning sequence of the scan driver.

12. The device of claim 10, each of the array of pixels further comprising a first transparent electrode, a second transparent electrode, and an electroluminescence layer formed between the first and second transparent electrodes.

13. The device of claim 12, the electroluminescence layer further comprising an organic electroluminescence material.

14. The device of claim 10, each of the array of pixels further comprising an organic light emitting diode.

15. The device of claim 10 further comprising a pair of masks respectively disposed on both sides of the display panel.

16. The device of claim 15, the mask further comprising one of a scroll lid or an electrochromic film.

17. A method of driving an electroluminescence display device comprising the steps of:

providing an electroluminescence display device with a single display panel that is transparent on both sides;

providing an array of pixels formed in rows and columns in the electroluminescence display device;

activating the array of pixels in a first sequence from a first row to a last row of the array of pixels if the transparent display panel is viewed from one side; and activating the array of pixels in a second sequence from a last row to a first row of the array of pixels if the transparent display panel is viewed from the other side.

18. The method of claim 17 further comprising the step of providing a control unit to control the first and second sequences.

19. The method of claim 17 further comprising the step of providing a mask disposed on one side of the transparent display panel.

20. The method of claim 17 further comprising the step of providing an organic light emitting diode in each of the array of pixels.

* * * * *